US008112999B2

(12) United States Patent
Zuo

(10) Patent No.: US 8,112,999 B2
(45) Date of Patent: Feb. 14, 2012

(54) TURBOMACHINE INJECTION NOZZLE INCLUDING A COOLANT DELIVERY SYSTEM

(75) Inventor: Baifang Zuo, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 862 days.

(21) Appl. No.: 12/186,271

(22) Filed: Aug. 5, 2008

(65) Prior Publication Data

US 2010/0031662 A1 Feb. 11, 2010

(51) Int. Cl.
*F02C 1/00* (2006.01)

(52) U.S. Cl. ..... 60/730; 60/737

(58) Field of Classification Search ..... 60/730, 60/734, 737, 740, 742, 748; 239/132, 132.1, 239/132.3, 132.5, 405, 424, 424.5; 431/160, 431/187

See application file for complete search history.

(56) References Cited

U.S. PATENT DOCUMENTS 4,100,733 A * 7/1978 Striebel et al. ..... 60/39.463
4,429,527 A 2/1984 Teets
4,845,952 A 7/1989 Beebe
5,263,325 A * 11/1993 McVey et al. ..... 60/738
5,339,635 A * 8/1994 Iwai et al. ..... 60/733
5,680,766 A 10/1997 Joshi et al.
5,865,030 A * 2/1999 Matsuhama ..... 60/736
5,930,999 A 8/1999 Howell et al.
6,019,596 A 2/2000 Knopfel et al.
6,438,961 B2 8/2002 Tuthill et al.
6,442,939 B1 9/2002 Stuttaford et al.
6,453,673 B1 9/2002 Bechtel et al.
6,672,073 B2 1/2004 Wiebe
6,993,916 B2 2/2006 Johnson et al.
7,107,772 B2 9/2006 Chen et al.
7,412,833 B2 8/2008 Widener
7,556,031 B2 7/2009 Russell
7,886,991 B2 2/2011 Zuo et al.
2007/0062197 A1 * 3/2007 Hannum et al. ..... 60/737
2008/0078160 A1 4/2008 Kraemer et al.
2009/0229269 A1 9/2009 Lacy et al.
2010/0008179 A1 1/2010 Lacy et al.
2010/0031662 A1 2/2010 Zuo
2010/0101229 A1 4/2010 York et al.

* cited by examiner

*Primary Examiner* — Louis Casaregola
*Assistant Examiner* — Phutthiwat Wongwian
(74) *Attorney, Agent, or Firm* — Cantor Colburn LLP

(57) ABSTRACT

An injection nozzle for a turbomachine includes a main body having a first end portion that extends to a second end portion defining an exterior wall having an outer surface. A plurality of fluid delivery tubes extend through the main body. Each of the plurality of fluid delivery tubes includes a first fluid inlet for receiving a first fluid, a second fluid inlet for receiving a second fluid and an outlet. The injection nozzle further includes a coolant delivery system arranged within the main body. The coolant delivery system guides a coolant along at least one of a portion of the exterior wall and around the plurality of fluid delivery tubes.

15 Claims, 3 Drawing Sheets

TURBOMACHINE INJECTION NOZZLE INCLUDING A COOLANT DELIVERY SYSTEM

This invention was made with Government support under Contract No. DE-FC26-05NT4263, awarded by the US Department of Energy (DOE). The Government has certain rights in this invention.

BACKGROUND OF THE INVENTION

Exemplary embodiments of the present invention relate to the art of turbomachine injection nozzles and, more particularly, to turbomachine injection nozzles including a coolant delivery system.

In general, gas turbine engines combust a fuel/air mixture which releases heat energy to form a high temperature gas stream. The high temperature gas stream is channeled to a turbine via a hot gas path. The turbine converts thermal energy from the high temperature gas stream to mechanical energy that rotates a turbine shaft. The turbine may be used in a variety of applications, such as for providing power to a pump or an electrical generator.

In a gas turbine, engine efficiency increases as combustion gas stream temperatures increase. Unfortunately, higher gas stream temperatures produce higher levels of nitrogen oxide (NOx), an emission that is subject to both federal and state regulation. Therefore, there exists a careful balancing act between operating gas turbines in an efficient range, while also ensuring that the output of NOx remains below mandated levels. One method of achieving low NOx levels is to ensure good mixing of fuel and air prior to combustion. However certain fuels, such as hydrogen and syngas, have a high flame speed, particularly when burned in a pre-mixed mode. The high flame speed often results in flame holding that detracts from operating efficiency and has a negative impact on operational life of turbine components.

BRIEF DESCRIPTION OF THE INVENTION

In accordance with an exemplary embodiment of the invention, an injection nozzle for a turbomachine includes a main body having a first end portion that extends to a second end portion defining an exterior wall having an outer surface. The injection nozzle also includes a plurality of fluid delivery tubes extending through the main body. Each of the plurality of fluid delivery tubes includes a first inlet for receiving a first fluid, a second inlet for receiving a second fluid and an outlet. The outlet is arranged at the exterior wall. The injection nozzle further includes a coolant delivery system arranged within the main body. The coolant delivery system guides a coolant along at least one of a portion of the exterior wall to cool the outer surface and around the plurality of fluid delivery tubes.

In accordance with another exemplary embodiment of the invention, a method of cooling an injection nozzle for a turbomachine includes guiding a first fluid into a plurality of fluid delivery tubes extending through a main body of the injection nozzle, passing a second fluid toward the plurality of fluid delivery tubes, and delivering the first and second fluids through an exterior wall of the injection nozzle. The method further includes passing a coolant along at least one of a portion of the exterior wall and around the plurality of fluid delivery tubes.

In accordance with still another exemplary embodiment of the invention, a turbomachine includes a compressor, a combustor operatively connected to the compressor, and an injection nozzle operatively connected to the combustor. The injection nozzle includes a main body having a first end portion that extends to a second end portion defining an exterior wall having an outer surface. The injection nozzle also includes a plurality of fluid delivery tubes extending through the main body. Each of the plurality of fluid delivery tubes includes a first fluid inlet for receiving a first fluid, a second fluid inlet for receiving a second fluid and an outlet. The outlet being arranged at the exterior wall. The injection nozzle further includes a coolant delivery system arranged within the main body. The coolant delivery system guides a coolant along at least one of a portion of the exterior wall to cool the outer surface and around the plurality of fluid delivery tubes.

DETAILED DESCRIPTION OF THE INVENTION

Figure 1:
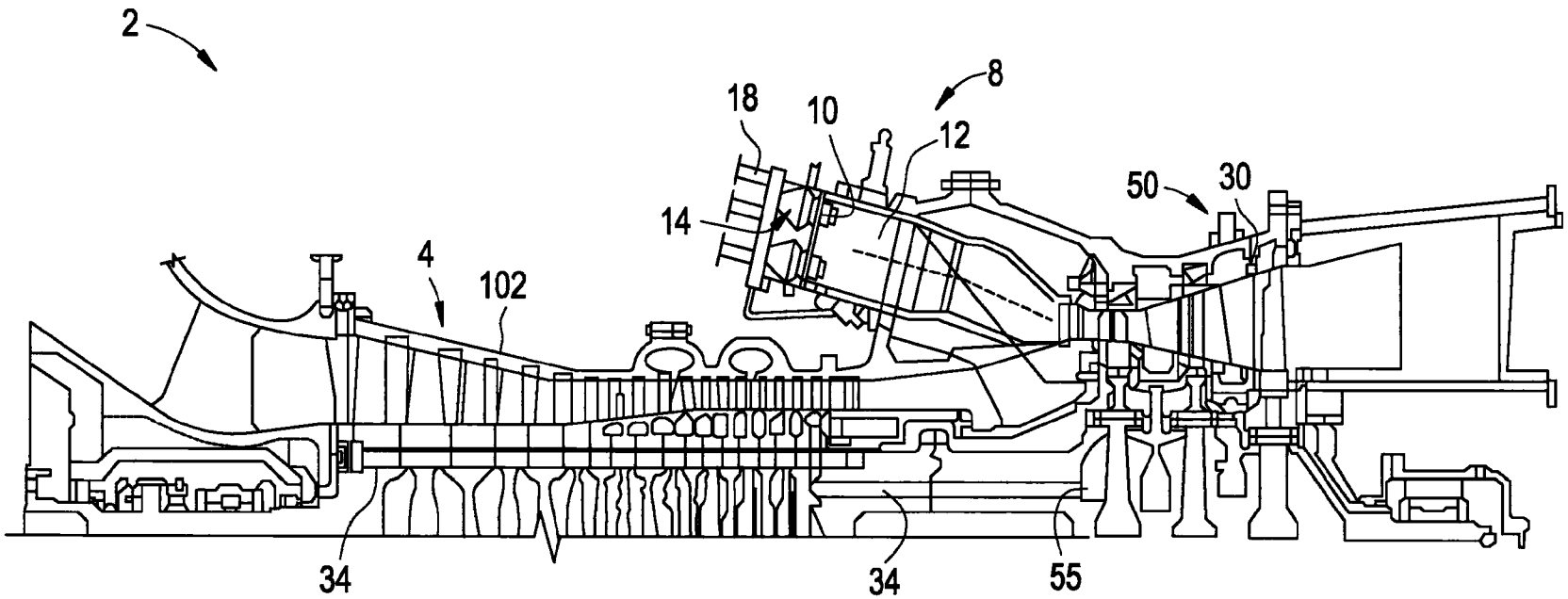
FIG. 1 is a cross-sectional side view of an exemplary gas turbine engine including an injection nozzle constructed in accordance with an exemplary embodiment of the invention.

FIG. 1 is a schematic illustration of an exemplary gas turbine engine 2. Engine 2 includes a compressor 4 and a combustor assembly 8. Combustor assembly 8 includes a combustor assembly wall 10 that at least partially defines a combustion chamber 12. A pre-mixing apparatus or injection nozzle 14 extends through combustor assembly wall 10 and leads into combustion chamber 12. As will be discussed more fully below, injection nozzle 14 receives a first fluid or fuel through a fuel inlet 18 and a second fluid or compressed air from compressor 4. The fuel and compressed air are mixed, passed into combustion chamber 12 and ignited to form a high temperature, high pressure combustion product or air stream. Although only a single combustor assembly 8 is shown in the exemplary embodiment, engine 2 may include a plurality of combustor assemblies 8 arranged in, for example, a can annular array. In any event, engine 2 also includes a turbine 30 operatively connected to a compressor/turbine shaft 34 (sometimes referred to as a rotor). Turbine 30 drives, shaft 34 that, in turn, drives compressor 4.

In operation, air flows into compressor 4 and is compressed into a high pressure gas. The high pressure gas is supplied to combustor assembly 8 and mixed with fuel, for example process gas and/or synthetic gas (syngas), in injection nozzle 14. The fuel/air or combustible mixture is then passed into combustion chamber 12 and ignited to form a high pressure, high temperature combustion gas stream. In addition to process gas and syngas, combustor assembly 8 can combust fuels that include, but are not limited to natural gas and/or fuel oil. In any event, combustor assembly 8 channels the combustion gas stream to turbine 30 which coverts thermal energy to mechanical, rotational energy.

Figure 2:
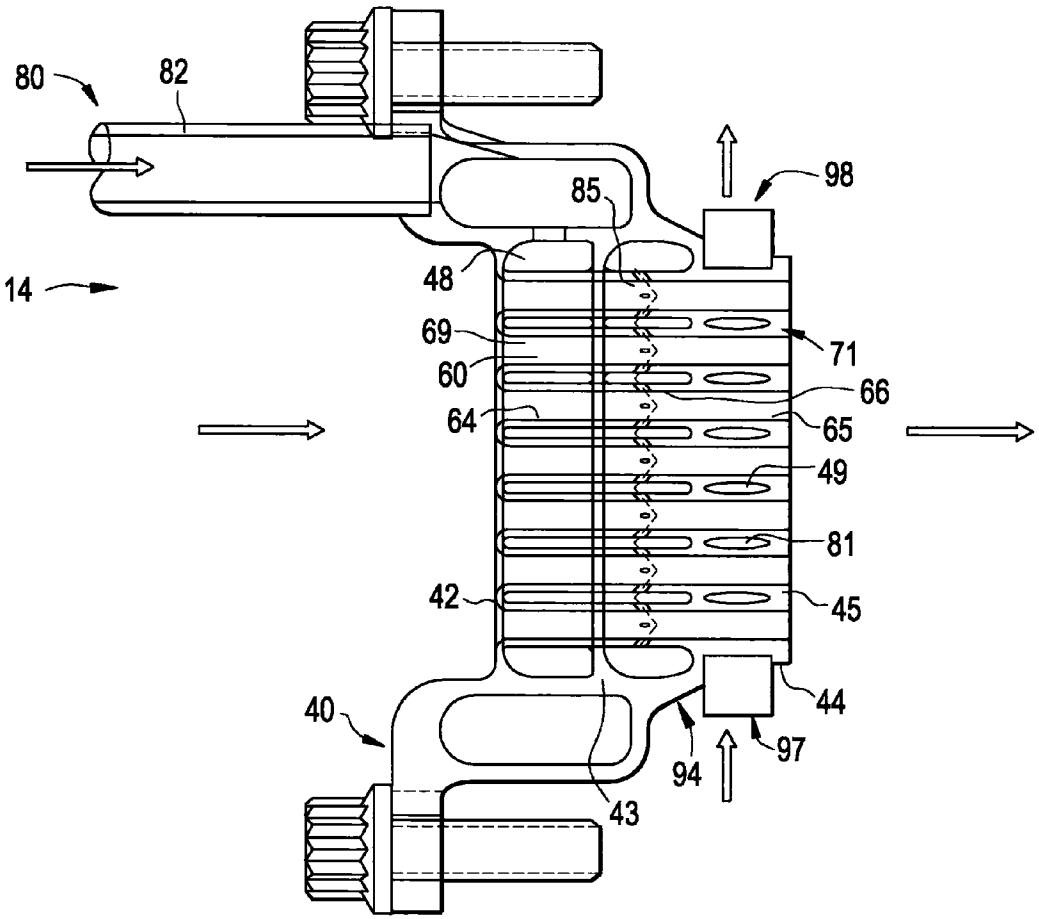
FIG. 2 is a cross-sectional side view of an injection nozzle constructed in accordance with an exemplary embodiment of the invention.

Reference will now be made to FIG. 2 in describing an injection nozzle 14 constructed in accordance with a first exemplary embodiment of the invention. As shown, injection nozzle 14 includes a main body 40 having a first end portion 42 that extends through an intermediate portion 43 to a second end portion 44. Second end portion 44 defines an exterior wall 45 having an outer surface 46. As will be discussed more fully below, injection nozzle 14 includes a first plenum 48 arranged within main body 40 adjacent first end portion 42 and a second plenum 49 arranged within main body 40 adjacent second end portion 44. Injection nozzle 14 is further shown to include a plurality of fluid delivery tubes, one of which is indicated at 60. Each fluid delivery tube 60 includes a first end section 64 that extends to a second end section 65 through an intermediate section 66. First end section 64 defines a first fluid inlet 69 while second end section 65 defines an outlet 71.

Injection nozzle 14 also includes a second fluid delivery system 80. Second fluid delivery system 80 includes a second fluid delivery member 82 that is fluidly connected to first plenum 48 that, in turn, is fluidly connected to a second fluid inlet 85 provided in each of the plurality of fluid delivery tubes 60. More specifically, each fluid delivery tube 60 includes a second fluid inlet 85, shown in the form of orifices or holes, formed in intermediate section 66. With this arrangement, a first fluid, generally air, is introduced through first fluid inlet 69 to each fluid delivery tube 60. A second fluid, generally fuel, is passed through second fluid delivery member 82 and into first plenum 48. The fuel flows around the plurality of fluid delivery tubes 60 and passes through each second fluid inlet 85 to mix with the air to form a fuel air mixture. The fuel air mixture passes from outlet 71 and is ignited to form high temperature, high pressure gases that are delivered to turbine 30. In order to minimize flame holding at exterior wall 45 thereby allowing the use of lower velocity air streams, injection nozzle 14 includes a coolant delivery system 94.

In accordance with the exemplary embodiment shown, coolant delivery system 94 includes a coolant inlet 97 and a coolant outlet 98 each of which are fluidly connected to second plenum 49. Second plenum 49 extends about or enveloped each of the plurality of fluid delivery tubes 60 as well as along internal surfaces (not separately labeled) of exterior wall 45. With this construction, coolant, typically in the form of water, is passed through coolant inlet 97 to second plenum 49. The coolant flows around each of the plurality of fluid delivery tubes 60 as well as adjacent an inner portion (not separately labeled) of exterior wall 45. The coolant than passes out from coolant outlet 98 and through a heat exchanger (not shown) prior to being re-introduced into coolant inlet 97. In this manner, the coolant flowing through plenum 49 lowers temperatures of plurality of fluid delivery tubes 60 and thereby enhances tube wall flame quench capability and flam flash back resistance. In addition, the coolant flowing near exterior wall 45 lowers local temperatures at outer surface 46 to provide an additional quench effect. The quench effect reduces flame holding, substantially prevents flash back and minimizes thermal cracking.

Figure 3:
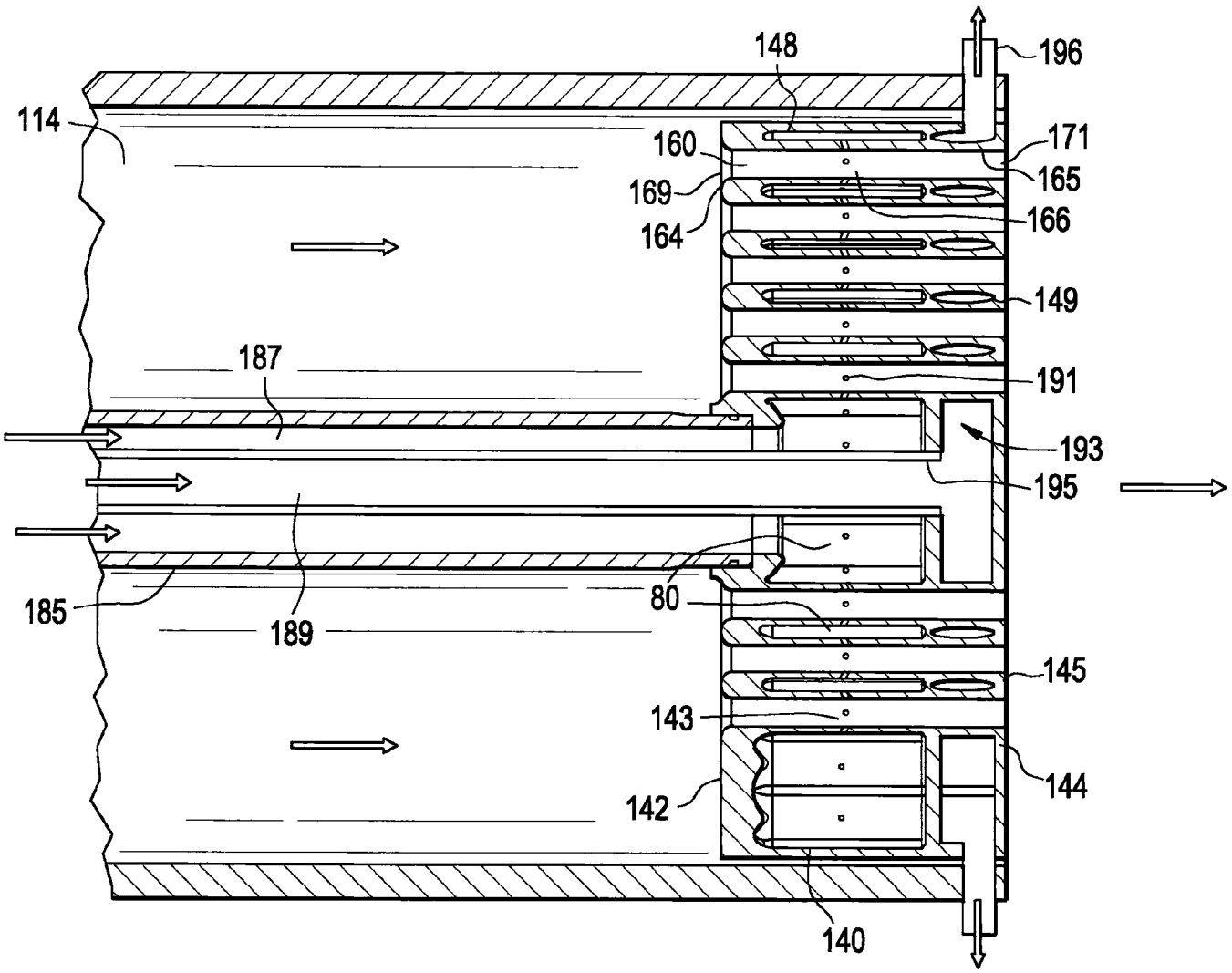
FIG. 3 is a cross-sectional side view of an injection nozzle constructed in accordance with another exemplary embodiment of the invention.

Reference will now be made to FIG. 3 in describing an injection nozzle 114 constructed in accordance with another exemplary embodiment of the invention. As shown, injection nozzle 114 includes a main body 140 having a first end portion 142 that extends through an intermediate portion 143 to a second end portion 144. Second end portion 144 defines an exterior wall 145 having an outer surface 146. As will be discussed more fully below, injection nozzle 114 includes a first plenum 148 arranged within main body 140 adjacent first end portion 142 and a second plenum 149 arranged within main body 140 adjacent second end portion 144. Injection nozzle 114 is further shown to include a plurality of fluid delivery tubes, one of which is indicated at 160. Each fluid delivery tube 160 includes a first end section 164 that extends to a second end section 165 through an intermediate section 166. First end section 164 defines a first fluid inlet 169 while second end section 165 defines an outlet 171.

Injection nozzle 14 also includes a second fluid delivery system 80. Second fluid delivery system 80 includes a fluid delivery conduit 185 having a first section 187 and a second section 189. First section 187 envelops second section 189 and is fluidly connected to first plenum 148 that, in turn, is fluidly connected to a second fluid inlet 191 provided in each of the plurality of fluid delivery tubes 160. More specifically, each fluid delivery tube 160 includes a second fluid inlet 191, shown in the form of an orifice, formed in intermediate section 166. In a manner similar to that described above, a first fluid, generally air, is introduced through first fluid inlet 169 to each fluid delivery tube 160. A second fluid, generally fuel, is passed through first section 187 of fluid delivery conduit 185 and into first plenum 148. The fuel flows around the plurality of fluid delivery tubes 160 and passes through each second fluid inlet 191 to mix with the air and form a fuel air mixture. The fuel/air mixture passes from outlet 171 and is ignited to form high temperature, high pressure gases that are delivered to turbine 30. In order to minimize flame holding at exterior wall 145 thereby allowing the use of lower velocity air streams, injection nozzle 114 also includes a coolant delivery system 193.

Coolant delivery system 193 includes an inlet 195 that is fluidly connected to second section 189 of fluid delivery conduit 185 and second plenum 149. Coolant delivery system 193 also includes a coolant outlet 196. With this arrangement, coolant, typically in the form of water, is passed through second section 189 of fluid delivery conduit 185, through coolant inlet 195 and into second plenum 149. The coolant flows around each of the plurality of fluid delivery tubes 160 as well as adjacent an inner portion (not separately labeled) of exterior wall 145. The coolant then passes out from coolant outlet 196 and through a heat exchanger (not shown) prior to being re-introduced into coolant delivery system 193. In this manner, the coolant flowing around through second fluid plenum 149 lowers temperatures of the plurality of fluid delivery tubes 160 and thereby provides better tube wall flame quench effects and enhances nozzle flame flashback resistance. In addition, the coolant flowing near exterior wall 145 lowers local temperatures to provide an additional quench effect. The quench effect reduces flame holding, substantially prevents flash back, and minimizes thermal cracking.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of exemplary embodiments of the present invention if they have structural elements that do not differ from the literal language of the claims, or if they include equivalent structural elements with insubstantial differences from the literal language of the claims.

The invention claimed is:

1. An injection nozzle for a turbomachine comprising:

a main body having a first end portion that extends to a second end portion defining an exterior wall having an outer surface;

a plurality of fluid delivery tubes extending through the main body, each of the plurality of fluid delivery tubes including a first fluid inlet for receiving a first fluid, a second fluid inlet for receiving a second fluid and an outlet, the outlet being arranged at the exterior wall; and a closed loop coolant delivery system arranged within the main body, the coolant delivery system guiding a coolant along at least one of a portion of the exterior wall to cool the outer surface and around the plurality of fluid delivery tubes.

2. The injection nozzle according to claim 1, wherein the closed loop coolant delivery system includes a coolant inlet arranged adjacent the exterior wall, the coolant inlet directing cooling fluid along the at least one of the portion of the exterior wall to cool the outer surface and the plurality of fluid delivery tubes.

3. The injection nozzle according to claim 2, wherein the closed loop coolant delivery system includes a coolant outlet arranged adjacent the exterior wall, the coolant outlet guiding coolant from the injection nozzle.

4. The injection nozzle according to claim 1, wherein the closed loop coolant delivery system includes a coolant inlet fluidly connected at the first end portion of the main body, the coolant inlet directing cooling fluid along the at least one of the portion of the exterior wall to cool the outer surface and the plurality of fluid delivery tubes.

5. The injection nozzle according to claim 4, further comprising: a second fluid delivery member fluidly connected at the first end portion of the main body, the second fluid delivery member delivering the second fluid toward the plurality of fluid delivery tubes.

6. The injection nozzle according to claim 1, further comprising: a fluid delivery conduit fluidly connected to the first end portion of the main body, the fluid delivery conduit including a first section that guides the second fluid toward the plurality of fluid delivery tubes and a second section that guides the coolant to the coolant delivery system.

7. The injection nozzle according to claim 6, wherein the first section of the fluid delivery conduit envelopes the second section of the fluid delivery conduit.

8. The injection nozzle according to claim 1, wherein the coolant comprises water.

9. A turbomachine comprising:

a compressor;

a combustor operatively connected to the compressor; and an injection nozzle operatively connected to the combustor, the injection nozzle including:

a main body having a first end portion that extends to a second end portion defining an exterior wall having an outer surface;

a plurality of fluid delivery tubes extending through the main body, each of the plurality of fluid delivery tubes including a first fluid inlet for receiving a first fluid, a second fluid inlet for receiving a second fluid and an outlet, the outlet being arranged at the exterior wall; and a closed loop coolant delivery system arranged within the main body, the coolant delivery system guiding a coolant along at least one of a portion of the exterior wall to cool the outer surface and around the plurality of fluid delivery tubes.

10. The turbomachine according to claim 9, wherein the closed loop coolant delivery system includes a coolant inlet arranged adjacent the exterior wall, the coolant inlet directing cooling fluid along the at least one of the portion of the exterior wall to cool the outer surface and the plurality of fluid delivery tubes.

11. The turbomachine according to claim 10, wherein the closed loop coolant delivery system includes a coolant outlet arranged adjacent the exterior wall, the coolant outlet guiding coolant from the injection nozzle.

12. The turbomachine according to claim 9, wherein the closed loop coolant delivery system includes a coolant inlet fluidly connected at the first end portion of the main body, the coolant inlet directing cooling fluid along the at least one of the portion of the exterior wall to cool the outer surface and the plurality of fluid delivery tubes.

13. The turbomachine according to claim 12, further comprising: a second fluid delivery member fluidly connected at the first end portion of the main body, the second fluid delivery member guiding the second fluid toward the plurality of fluid delivery tubes.

14. The turbomachine according to claim 9, further comprising: a fluid delivery conduit fluidly connected to the first end portion of the main body, the fluid delivery conduit including a first section that guides the second fluid toward the plurality of fluid delivery tubes and a second section that guides the coolant to the coolant delivery system.

15. The turbomachine according to claim 14, wherein the first section of the fluid delivery conduit envelopes the second section of the fluid delivery conduit.

* * * * *